United States Patent [19]

House

[11] 4,000,831

[45] Jan. 4, 1977

[54] SLICED BREAD DISPENSER

[75] Inventor: Bruce F. House, Miami, Fla.

[73] Assignee: Shelley Manufacturing Company, Miami, Fla.

[22] Filed: Dec. 11, 1975

[21] Appl. No.: 639,878

[52] U.S. Cl. ..... 221/196; 221/227; 221/229; 221/232; 221/245; 221/246

[51] Int. Cl.[2] ..... B65H 3/00

[58] Field of Search ..... 221/232, 229, 245, 246, 221/228, 227, 195, 196, 99

[56] References Cited

UNITED STATES PATENTS

| | | | |
|---|---|---|---|
| 2,502,248 | 3/1950 | Colton et al. | 221/228 |
| 2,771,979 | 11/1956 | Lenhart | 221/196 X |
| 3,358,881 | 12/1967 | Medina | 221/227 |
| 3,578,207 | 5/1971 | Danow | 221/232 |

*Primary Examiner*—Allen N. Knowles
*Attorney, Agent, or Firm*—Ernest H. Schmidt

[57] ABSTRACT

A rectangular, vertically-extending tank having an upwardly-extending, spring-pressed pressure head automatically feeds sliced bread against the underside of a cover plate supported for horizontally reciprocative, forth-and-back movement over the upper end of the tank. The cover plate has a transverse sidewall portion centrally disposed along its length and operative to push uppermost slices of bread, one at a time, forwardly to slide off the upper end of the pressure plate for deposit on a receiving tray each time the cover plate is moved manually through a forth-and-back cycle of operation. Ratchet and pawl mechanism operative between the cover plate and its guide means prevents retrograde movement prior to completion of the sliding movement in one direction or the other.

12 Claims, 5 Drawing Figures

SLICED BREAD DISPENSER

This invention relates to food dispensing equipment and is directed particularly to a sliced bread or sandwich dispenser suitable for use in self-service cafeterias, restaurants and the like.

The principal object of this invention is to provide a novel and improved sliced bread or sandwich dispenser comprising a vertically-extending tank or container receivable in an appropriate opening in a countertop or the like, which serves as a magazine containing sliced bread to be dispensed, and including a horizontally reciprocable slide cover at the upper end operative to engage and slidingly withdraw for dispensing the uppermost slice, and further including a spring-pressed pressure plate serving to urge the next uppermost slice into dispensing position upon the return of the slide cover to rest position after a dispensing operation.

A more particular object of the invention is to provide a sliced bread dispenser of the above nature wherein the reciprocative slide cover is of such size and configuration as to completely cover the upper end of the sliced bread container or tank both while at rest and during a slice dispensing operation to minimize any possibility of contamination of the contained bread.

Another object of the invention is to provide a sliced bread dispenser of the character described including mechanism preventing retrograde sliding of the cover prior to completion of a dispensing operation stroke to minimize the possibility of jambing of bread slices which might otherwise occur.

Still another object of the invention is to provide a sliced bread dispenser of the character described wherein the reciprocable slide cover can readily be removed and replaced for refilling the sliced bread container.

Still another object of the invention is to provide a sliced bread dispenser as herein above described including a crumb drawer at the lower end of the sliced bread receiving tank or container for the collection and convenient disposal of bread crumbs falling to the bottom of the container during use of the dispenser.

Another object of the invention is to provide a sliced bread dispenser of the above nature which will be simple in construction, foolproof in operation, easy to reload and clean, attractive in appearance, and durable in operation.

Other objects, features and advantages of the invention will be apparent from the following description when read with reference to the accompanying drawings. In the drawings, wherein like reference numerals denote corresponding parts throughout the several views.

Figure 1:
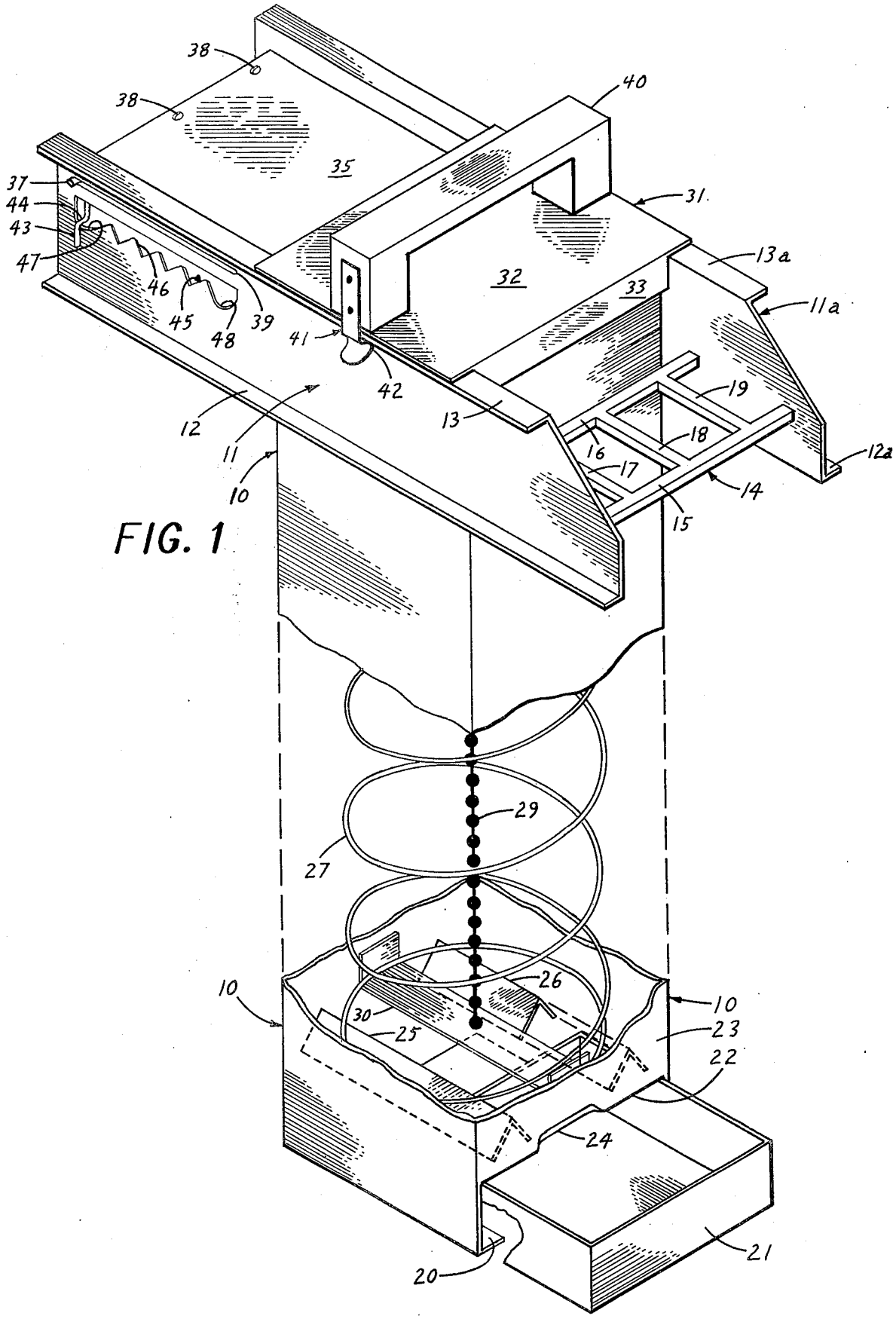
FIG. 1 illustrates, in perspective, a sliced bread dispenser embodying the invention, portions thereof being broken away to reveal details of construction.

As illustrated in FIG. 1, the sliced bread dispenser comprises a substantially rectangular container or tank

10 along opposite sidewall portions of which, at the upper end, are spot-welded or otherwise securely fixed channel-shaped guide rail members 11,11*a* having laterally opposed lower outwardly-extending flange portions 12,12*a* and laterally opposed upper outwardly-extending flange portions 13,13*a*, respectively. The container 10 and guide rail members 11,11*a* are preferably fabricated of stainless steel sheet metal. The guide rail members 11,11*a* project both forwardly and rearwardly of the upper end of the container 10, and said forwardly projecting guide rail member ends have welded or otherwise secured therebetween a horizontal rack 14 for receiving deposited thereupon a dispensed slice of bread, as is herein below described.

The sliced bread rack 14 is preferably comprised of a pair of horizontally spaced stainless steel rods or bars 15,16 transversely joined by a plurality of transversely extending rods or bars 17,18, and 19.

The lower end of the sliced bread container 10 is open, except for bent-in flanges 20 at each side, (only one illustrated), which serve as slide surfaces for a shallow, rectangular crumb drawer 21 receivable in an opening 22 at the lower end of the front wall 23 of said container, said front wall being forshortened to define said opening. A lower marginal end portion of the front wall 23 is formed with an indentation 24 providing for finger access to an upper front wall portion of the crumb drawer 21 to facilitate its withdrawal for emptying.

Figure 2:
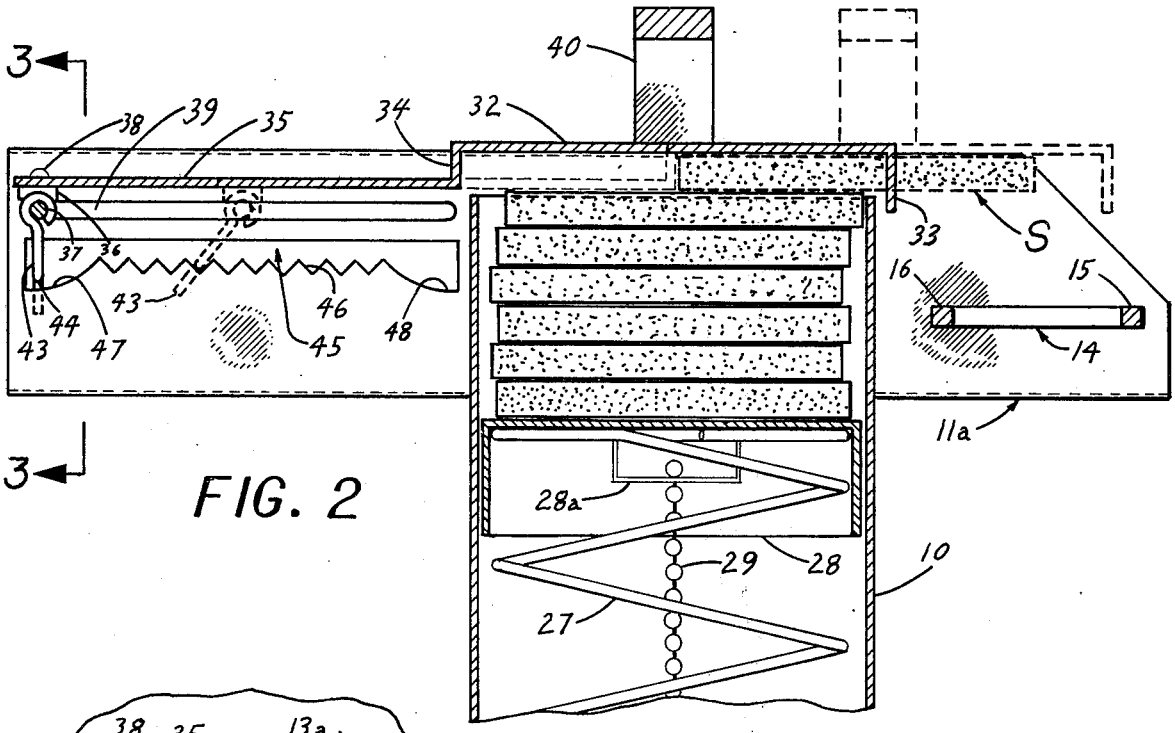
FIG. 2 is a partial vertical cross-sectional view of the bread dispenser taken from front to back, illustrating mechanical details.

Support means in form of a pair of parallel, angularly-bent members 25,26 fixed within the container 10 just above the crumb drawer opening 24 abuttingly position the lower end of a helical compression spring 27, the upper end of which is constrained against the underside of a skirted, rectangular, substantially flat pressure head member 28 slidably received within said container, (see FIG. 2). Restraining means in the form of a bead chain 29 fixed at one end of the underside of the pressure head 28 by means of right angular bracket 28*a*, and at the other end to a front-to-back bar 30 secured at the upper level of the angularly-bent members 25,26 prevents passage of said pressure head outwardly of the upper end of the container 10 upon loading the bread dispenser with sliced bread to be dispensed.

Reciprocably slidable cover plate 31 is provided at the upper end of the container 10. The cover plate 31 is preferably integrally formed with a rectangular front top wall portion 32 opposite sidewall portions of which are slidably disposed atop the upper surfaces 13,13*a* of respective guide rail members 11,11*a*, a short, depending skirt portion 33 extending between inner sidewall portions of said guide rail members, a short depending rear wall portion 34, and a flat, horizontally-extending bottom wall portion 35, said rear wall portion and said bottom wall portion also extending between said guide rail members 11,11*a*.

Figure 3:
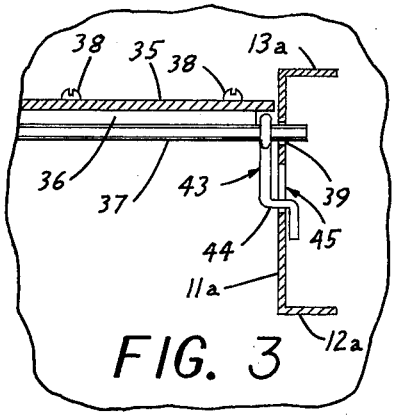
FIG. 3 is a partial vertical cross-sectional view, taken along the line 3—3 of FIG. 2 in the direction of the arrows.
Figure 4:
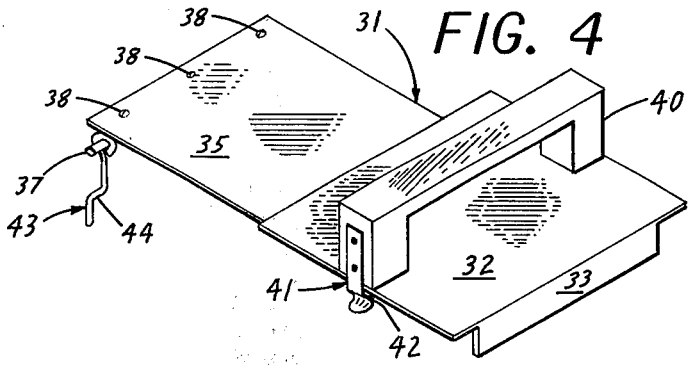
FIG. 4 is a top perspective view of the slidable cover plate, shown separately.
Figure 5:
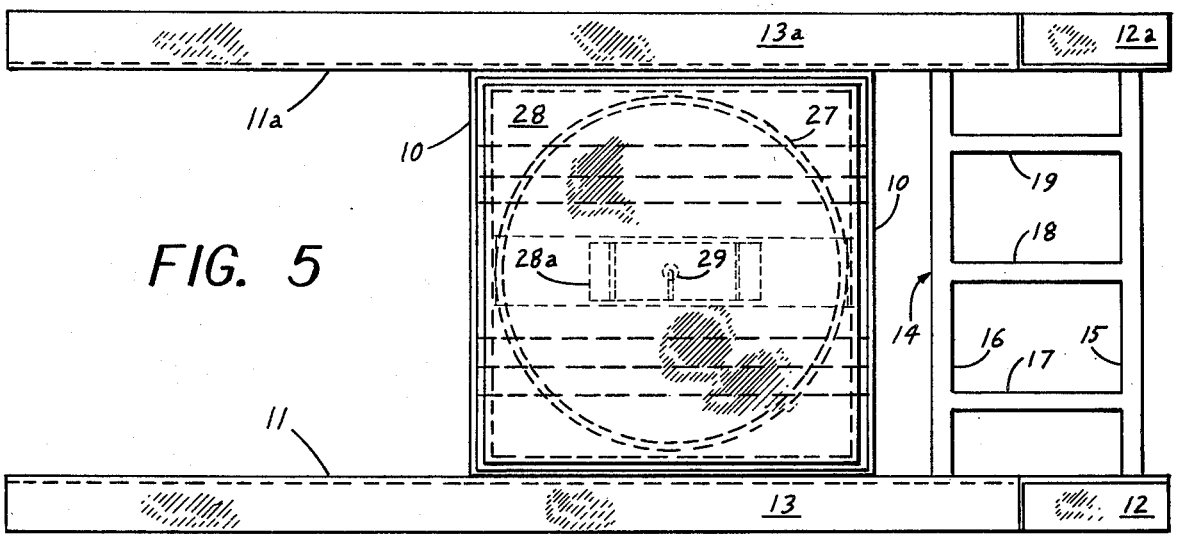
FIG. 5 is a top view of the dispenser, with the cover plate removed.

As best illustrated in FIGS. 2 and 3, the underside of the cover plate bottom wall portion 35 has fixed along its underside, at the outer end thereof, a transverse bar 36 supporting a transverse pivot rod 37, the ends of which project through longitudinally-extending slots 39 in the guide rail members 11,11*a*. A plurality of machine screws 38 may be used to screw the rod 37 in place. This pin and slot mechanism serves not only as limit means for the reciprocative movement of the cover plate member 31 upon operation of the dispenser as hereinbelow described, but also serves as pivot means for swingably moving the front portion of said cover plate member upwardly and rearwardly of the upper end of the container 10 to permit reloading with sliced bread to be dispensed.

A U-shaped handle 40 is secured across the top of the front top wall portion 32 of the slidable cover plate 31 for manual control of the reciprocative sliding motion in a dispensing operation. Leaf spring detent members 41 affixed against each end of the handle 39 and extending beyond the underside of the front top wall portion 32 to terminate in inwardly-curved spring detent portions 42, provide for removable securement of said front top wall portion against the guide rail member flange portions 13,13*a* while at the same time permitting back and forth sliding motion therealong.

As best illustrated in FIG. 2, the guide rail members 11,11*a* extend upwardly of the upper end of the container 10 by a distance approximately equal to the thickness of a slice of bread to be dispensed, and the height of the inside of the depending rear wall portion 34 of the cover plate 31 is slightly less than this height so that as the cover plate handle 40 is pulled forwardly, as indicated by the broken-line representation thereof in FIG. 2, the uppermost slice of bread will be pushed forwardly off the flat upper surface of the pressure head 28 to be dispensed upon the rack 14 upon reaching the forward limit position of the rod 38 in the longitudinally extending slots 39.

Means is provided to prevent return of the cover plate member 31 to its rearward-most or rest position before a slice dispensing operation, once begun, has been completed. To this end, the transverse rod 37 has pivotally linked thereon at the inside of the guide rail members 11,11*a*, bent rod pawls 43, each having a right-angular offset portion 44 extending through longitudinally-extending ratchet openings 45 in said guide rail members below their respective guide slots 39. The lower edges of each of the ratchet openings 45 are formed with a plurality of ratchet teeth 46 along which the pawls 43 move.

Thus, as illustrated by the broken-line representation thereof in FIG. 2, as the cover plate is pulled forwardly in a dispensing operation, the right-angular offset portions 44 of the bent rod pawls 43 will ride angularly along the ratchet teeth 46 to prevent return movement of said cover plate member until it is pulled to its forward limit position as determined by the forward ends of the slots 39, whereat the uppermost slice of bread S will be pushed forwardly outwardly of the top of the container 10 to be deposited for use upon the dispensing rack 14. At this position, the pawls 43 will swing vertically in the respective enlarged openings 48 provided at the forward ends of ratchet openings 45 to permit return movement of the cover plate to its rearward-most position, ready for the dispensing of the next slice of bread. In this connection, it is also to be noted that during rearward movement, the pawls 43 will move angularly along the ratchet teeth 46 behind the transverse rod 37, preventing forward motion for the next dispensing operation until said cover plate has been fully returned to starting position, whereat the next slice of bread to be dispensed will be urged flat upwardly against the underside of the front top wall portion 32 of the cover plate 31. At the rearward-most position of the cover plate 31, as illustrated in FIGS. 1 and 2, the pawls 43 are permitted to swing downwardly into the respective openings 47, to permit forward movement of said cover plate again.

It is further to be noted that the cover plate, in its back and forth movement of a dispensing operation, uncovers for dispensing only the uppermost bread slice S, the remaining slices being protectively covered at all times. This feature minimizes any possibility of contamination of the bread, such as by coughing or sneezing of persons moving along a self-service food line. Preferably, the cover plate 31 will be integrally fabricated of a clear, tough synthetic plastic material to permit viewing of the uppermost slice of bread to be dispensed.

Reloading of the bread dispenser is readily accomplished by pulling upwardly upon the handle 40 of the cover plate 31, swinging it to the rear about the pivotal connection afforded by the transverse rod 47 being journalled at each end in the slots 39 of the guide rail members 11,11*a*. As illustrated in FIG. 1, the crumb drawer 21 can readily be removed from time to time for emptying whenever required.

While I have illustrated and described herein only one form in which my invention can conveniently be embodied in practice, it is to be understood that this form is given by way of example only, and not in a limiting sense.

The invention, in brief, comprises all the embodiments and modifications coming within the scope and spirit of the following claims.

What I claim as new and desire to secure by Letters Patent is:

1. A sliced bread or sandwich dispenser comprising, in combination, a vertically-extending open top container for receiving stacked sliced bread for dispensing, a cover plate, means slidingly supporting said cover plate in spaced relation above the open top of said container for horizontally reciprocative forth-and-back movement, means limiting the extent of said cover plate movement between a backward-most first position of rest and forward-most second position of sliced bread dispensing, and means for resiliently constraining stacked sliced bread in said container in the upward direction so that the uppermost slice contacts the under-side of said cover plate, said cover plate being formed intermediate its length with a downwardly-extending, transverse wall portion serving as abutment means for slidingly pushing said uppermost slice of bread horizontally outwardly of said container as said cover plate is moved from said first position to said second position, said means slidingly supporting said cover plate in spaced relation above the open top of said container comprising a pair of horizontally-extending guide rail members secured, one each, against opposed upper sidewall portions of said container, said guide rail members projecting both forwardly and rearwardly of said container, and a rack extending horizontally between the forwardly-projecting ends of said guide rail members, below the upper end of said container, for the deposit or removal of a slice of bread pushed outwardly of said container during a dispensing operation.

2. A sliced bread or sandwich dispenser as defined in claim 1 wherein said means for resiliently constraining stacked sliced bread in said container in the upward direction comprises a substantially rectangular pressure head member slidably fitted in said container, spring support means near the lower end of said container, and a helical compression spring constrained between said support means and the underside of said pressure head member.

3. A sliced bread or sandwich dispenser as defined in claim 2, including means limiting the upward movement of said pressure head member beyond the upper end of said container under the urging of said compression spring.

4. A sliced bread or sandwich dispenser as defined in claim 3, including a rectangular opening in a sidewall portion of said container at the bottom thereof, and a crumb drawer slidably receivable therein for the removal for emptying from time to time of bread crumbs falling to the bottom of said container.

5. A sliced bread or sandwich dispenser as defined in claim 1, wherein said means slidably supporting said cover plate in spaced relation above the open top of said container comprises a pair of laterally-opposed, horizontally outwardly-extending flange portions integrally formed along said guide rail members, said cover plate having a rectangular front top wall portion transverse marginal outer end portions of which are abuttingly received in face-to-face relation upon upper surface portions of said guide rail flange portions.

6. A sliced bread or sandwich dispenser as defined in claim 5, wherein said cover plate is further formed with a bottom wall portion extending rearwardly of said transverse wall portion, said bottom wall portion being received between said guide rail members, said back and forth movement limiting means of said cover plate comprising a longitudinally-extending slot in one of said guide rail members and a rod member extending laterally outwardly of a rear end portion of said cover plate bottom wall portion and extending through said longitudinally-extending slot.

7. A sliced bread or sandwich dispenser as defined in claim 6, including releasable means for retaining said marginal outer end portions of said rectangular front top wall portion of said cover plate in face-to-face relation with respect to said guide rail flange portions.

8. A sliced bread or sandwich dispenser as defined in claim 7, wherein said releasable means comprises detent spring members extending downwardly of opposed lateral edge portions of said rectangular front top wall portion of said cover plate and adapted to engage beneath outer edge portions of said flange portions of said guide rail members.

9. A sliced bread or sandwich dispenser as defined in claim 8, including means preventing retrograde movement of said cover plate along said guide rail members during movement either between said first to said second positions or between said second and said first positions.

10. A sliced bread or sandwich dispenser as defined in claim 9, wherein said retrograde movement prevention means comprises ratchet means extending longitudinally with respect to one of said guide rail members, and a pawl pivotally joined with respect to said cover plate and operative to ride along teeth of said ratchet means during motion intermediate the end limit positions of said cover plate with respect to said guide rail members, the ends of said ratchet means being provided with toothless recesses enabling reversal of angular movement of said pawl at either end position of said cover plate.

11. A sliced bread or sandwich dispenser as defined in claim 10, wherein said cover plate is integrally formed of a clear synthetic plastic material to provide for viewing of the uppermost slice of bread in said container next ready for dispensing.

12. A sliced bread or sandwich dispenser comprising, in combination, a vertically-extending open top container for receiving stacked sliced bread for dispensing, a cover plate, means slidingly supporting said cover plate in spaced relation above the open top of said container for horizontally reciprocative forth-and-back- movement, means pivotally supporting one end of said cover plate with respect to said open top of said container for selectively swinging said cover plate upwardly and away from said open top for loading said container with sliced bread, means limiting the extent of said reciprocative cover plate movement between a backward-most first position of rest and forward-most second position of sliced bread dispensing, and means for resiliently constraining stacked sliced bread in said container in the upward direction so that the uppermost slice contacts the under-side of said cover plate, said cover plate being formed intermediate its length with a downwardly-extending, transverse wall portion serving as abutment means for slidingly pushing said uppermost slice of bread horizontally outwardly of said container as said cover plate is moved from said first position to said second position.

* * * * *